US005154840A

United States Patent [19]

Drake et al.

[11] Patent Number: 5,154,840

[45] Date of Patent: Oct. 13, 1992

[54] ENVIRONMENTALLY FRIENDLY GREASE COMPOSITIONS

[75] Inventors: David A. Drake, Houston; Thomas F. Wulfers, Seabrook, both of Tex.

[73] Assignee: Lyondell Petrochemical Company, Houston, Tex.

[21] Appl. No.: 817,928

[22] Filed: Jan. 6, 1992

[51] Int. Cl.[5] ..... C10M 125/30; C10M 141/02

[52] U.S. Cl. ..... 252/21; 252/39; 252/18

[58] Field of Search ..... 252/21, 18, 39

[56] References Cited

U.S. PATENT DOCUMENTS 4,784,795 11/1988 Fahl ..... 252/49.6
4,909,951 3/1990 Mendelson et al. ..... 252/39
4,960,740 10/1990 House et al. ..... 501/148

*Primary Examiner*—Jacqueline Howard
*Attorney, Agent, or Firm*—Arnold, White & Durkee

[57] ABSTRACT

The present invention provides an environmentally friendly grease composition. The base components of this lubricating composition include a white mineral oil in the amount of about 65 to about 85% by weight based on total weight of the composition, an extreme pressure additive comprising a solid friction modifier in an amount of about 1 to about 20 wt %, a thickener and a minor amount of one or more oil dispersible additives in amounts sufficient to enhance the performance characteristics of the greases. Each of the extreme pressure additive, thickener, and the one or more oil dispersible additives is essentially free of heavy metals, particularly arsenic, antimony, barium, cadmium, chromium, copper, iron, lead, mercury, molybdenum, nickel, selenium, vanadium and zinc. The greases of the present invention meet or exceed the EPA acceptance standards in effect during 1991 which are defined by the static sheen test and the 96-hour *Mysidopsis bahia* (shrimp) tests for offshore and inland water use.

11 Claims, No Drawings

ENVIRONMENTALLY FRIENDLY GREASE COMPOSITIONS

FIELD OF THE INVENTION

The present invention relates to grease compositions, and more particularly "extreme pressure greases," such as for example greases that will perform satisfactorily under extreme pressures common to the oil drilling industry.

BACKGROUND OF THE INVENTION

There is a continuing and urgent need for lubricants that can be used in environmentally sensitive areas. One particularly sensitive environment is the marine environment wherein containment poses a problem. For example on offshore drilling rigs, any leak or accidental discharge of a lubricant could go directly into the sea and intercoastal waters.

Typical lubricants used in industrial devices generally contain a mineral oil and additional additives that impart desired performance characteristics, such as antioxidants, corrosion inhibitors, viscosity builders, thickeners, antifoaming agents and load carrying additives. For the most part, commercial lubricants used in marine environments have included oil which contains some reactive hydrocarbons such as aromatics, and other additives containing heavy metals, such as molybdenum or zinc. In an accidental spill or leak, this oil may come into contact with the marine environment, leaving an oily sheen. This sheen can block the sunlight and affect the oxygen content of the water and growth of the microbes and algae. Any imbalance in the oxygen content may disturb the overall eco system of the waterways.

The present invention provides environmentally friendly lubricants useful for the industrial application in the marine environment such as encountered in the oil drilling industry. The lubricants of this invention contain no known toxic compounds, such as heavy metals, dioxin precursors, or any material on any list of chemicals in a concentration that could cause harm to the environment. The lubricants of this invention do not leave a sheen if accidentally spilled onto waterways.

SUMMARY OF THE INVENTION

The present invention provides an environmentally friendly grease composition. The base components of this lubricating composition include a white mineral oil in the amount of about 65 to about 85% by weight based on total weight of the composition, an extreme pressure additive comprising a solid friction modifier in an amount of about 1 to about 20 wt %, a thickener and a minor amount of one or more oil dispersible additives in amounts sufficient to enhance the performance characteristics of the greases. Each of the extreme pressure additive, thickener, and the one or more oil dispersible additives is essentially free of heavy metals, particularly arsenic, antimony, barium, cadmium, chromium, copper, iron, lead, mercury, molybdenum, nickel, selenium, vanadium and zinc. The greases of the present invention meet or exceed the EPA acceptance standards in effect during 1991 which are defined by the Static Sheen Test and the 96-hour *Mysidopsis bahia* (shrimp) tests for offshore and inland water use.

As used herein, the term "essentially free of heavy metals" is not constrained to mean absolutely no heavy metals, but does allow for trace amounts of heavy metals so long as the amount of any one heavy metal does not exceed the Threshold Planning Quantities (TPQs) or Reportable Quantities (RQs) defined by the Environmental Protection Agency in Title III of the Superfund Amendments and Reauthorization Act of 1986 (SARA) Sections 302, 304 and 313; 40 CFR §§302, 355 and 372 (Jul. 1, 1987 edition).

DETAILED DESCRIPTION OF THE PREFERRED EMBODIMENTS

The petroleum white oils which can be employed to make the grease of this invention are, for example, medicinal white oils, food grade white oils and technical grade white oils. Such oils include refined oils having a viscosity of about 30 to about 500 SUS at 100° F. White oils are colorless, odorless, oily liquids obtained by the refining of crude petroleum feedstocks. In the production of white oils, the petroleum feedstocks are refined to eliminate as completely as possible oxygen, nitrogen and sulfur compounds, and reactive hydrocarbons such as olefins and aromatics. White oils are composed almost entirely of saturated cyclic and aliphatic $C_{26-40}$ hydrocarbons. They are extremely stable to high temperatures, oxidizing atmospheres, and somewhat resistant to microbial degradation.

White oils generally fall into two classes, that is, technical grade white oils which are used in cosmetics, textile lubrication, bases for insecticides and the like, and more highly refined food grade and medicinal white oils. White oil specifications are rather difficult to meet, as such oils must be colorless, odorless, and must meet or exceed the U.S. Food and Drug Administration (FDA) Regulation 21 CFR 178.3620(a) or (b).

Particularly preferred white oils for use in the invention include ARCOwhite, ARCOprime®, ARCOpac® oils, and Tufflo® 6000 series, all products of Lyondell Petrochemical Company. These oils come in various viscosities, such as low viscosity oils (30 to 100 SUS at 100° F.) and high viscosity oils (over 400 SUS at 100° F.). Generally, for formulating greases, the amount of white oil will vary within the range of about 65 to about 85% by weight of total composition.

Because white oils are highly refined and specifically lack reactive hydrocarbons, namely aromatics, these oils will not leave a sheen if they are introduced on water. Further, because these oils are transparent, they will not measurably alter the sunlight transmission to the marine environment. The white oils alone, however, are not effective lubricating compositions for the harsh and demanding needs of the oil drilling tools and machines. Thus, the environmentally friendly greases of this invention must also contain an extreme pressure additive sufficient to meet the load carrying capacity demands of oil producing machinery, e.g., high pressure hydraulic systems and jacking devices on the rig.

Load carrying additives may be divided into two general classes, namely antiwear and extreme pressure additives. When two lubricated moving surfaces are lightly loaded against each other, they are separated by an oil film. As the load increases, the film decreases and eventually the surface roughness exceeds the thickness of the film. In these conditions, antiwear additives improve the oil film strength and thus reduce intermetallic contact. On the other hand, when the load is increased further, as happens in drilling rigs, the antiwear additives are no longer sufficient to protect the surface. Extreme pressure additives function by (a) reacting with the metal surface to form an inorganic metal compound, such as iron sulfide, which prevents meshing of metal surfaces, or (b) providing solid crystalline surface which allows two metal surfaces to glide.

While numerous extreme pressure additives have been described in the patent literature, most commercially available extreme pressure additives are composed of heavy metal salts or complexes. For example, molybdenum disulfide is often the extreme pressure additive of choice. While the heavy metal salts and complexes are generally believed to impart the best extreme pressure load carrying functional characteristics to a grease, they offer considerable drawbacks in connection with use in environmentally sensitive areas: the heavy metals may pollute the water. Further, the heavy metal salts and complexes are dark colored and tend to stain whatever they contact, including workers' hands and clothes, machinery, and coastal sand. Notwithstanding the undesirable effects heavy metals might pose, many thought that these additives were necessary to impart the necessary load carrying capacity required for high speed, high load equipment used on drilling rigs. The present inventive greases were formulated to avoid inclusion of heavy metal components without sacrificing load carrying capacity.

For purposes of this invention, the extreme pressure additives are selected to be essentially free of heavy metals. Examples of load carrying additives which should prove useful for this invention include solid crystalline friction modifiers such as white graphite, calcium carbonate, tricalcium phosphate, calcium fluoride, or calcium sulfate. Generally, the extreme pressure additive is in the amount of about 1 to about 20 wt % of the total composition.

Other additives useful for inclusion in the lubricating compositions of this invention include, but are not limited to, dispersants, soaps, detergents, antioxidants, emulsifiers, demulsifiers, solid crystalline friction modifiers, anti-rust agents, corrosion inhibitors, viscosity improvers, dyes, solvents to improve handleability, antifoaming agents and combinations thereof. These additives may be present in various amounts depending upon the desired performance characteristics of the final product. For purposes of this invention, the selected additives are essentially free of heavy metals. Such additives may include, but are not limited, to the following:

Viscosity improvers can be added in the form of a colorless or white polymer or copolymer, such as, for example, hydrogenated butadiene/styrene copolymers, polybutene, polyisobutene, suitable for food additive use, ethylene propylene copolymer, polyether, polyester or polypropylene. Generally in keeping with the constraints of this invention, the viscosity improving polymer as used in a lubricant meets or exceeds the standards set forth in 21 CFR 178.3570. Viscosity improvers are generally used to formulate to gear lubricating compositions and added in an amount of about 30 to 49 wt %.

Additional detergents or soaps in an amount of about 0.2 to about 30 wt % can be added. Soaps are often employed in making greases and as such are added in an amount of about 1 to 20 wt %. Generally, the soap is a calcium or aluminum salt of an animal or plant fatty acid or derivatives thereof. Aluminum or calcium complex soaps are used if high temperature applications are desired. Alternatively, detergents in the form of a highly overbased calcium and/or aluminum and/or sodium sulfonate detergent can also be added in an amount of about 0.2 to about 3 wt %. Also in formulating greases, a natural clay thickener such as bentonite is often added in an amount of about 5 to 20 wt %.

Small amounts of antifoaming agents may also be added to the formulation. Such antifoaming agents are generally present in an amount of about 50 to about 200 parts per million. Such antifoaming agents are well known commercial products known and available to those skilled in the art. Small amounts (0.1 to 2.0 wt %) of other known additives may also be present such as pour point depressants, antioxidants, corrosion inhibitors and antirust agents.

The following examples are provided so as to enable those of ordinary skill in the art to make compositions of the invention. These examples are not intended to limit the scope of what the inventors regard as their invention. Efforts have been made to ensure accuracy with respect to numbers used to characterize the measured conditions; however, some experimental errors and deviations may be present.

The compositions of the invention are made by normal blending and mixing techniques, generally at room temperatures or slightly elevated temperatures to facilitate dissolution and mixing of the ingredients. Any of the generally used types of blending apparatus can be used, including fixed in-line blenders and batch stirrers.

EXAMPLE I

A grease composition was made by blending ARCO white oil (CAS No. 8042-47-5) in an amount ranging from 70 to 80 wt % with bentonite clay (CAS 1302-78-9) in an amount of 5 to 15 wt %; calcium complex salt soap of a fatty acid in an amount of 1 to 5 wt %; aluminum complex soap derived from animal or plant fatty acids in an amount of 5 to 10 wt %; an extreme pressure additive $CaCO_3$ in an amount of 15 to 20 wt %; and an additive mixture of rust, oxidation and corrosion inhibitors comprising alkylated phenol and phenolic amine, each in an amount of less than 1%; and a small amount of dye to impart a light blue color.

The resultant grease has the following characteristics:

| | | |
|---|---|---|
| Color | Blue | |
| Texture | Smooth-Tacky | |
| Consistency Grade | NLGI No. 2 | |
| Work Penetration (D-217) | 280 | 265–295 |
| Dropping Point, °F. (D-566) | 510 | 500 Min. |
| Bearing Leakage, % (D-1263) | 4.5 | 5 Max. |
| Oil Separation, % (D-1742) | 2.0 | 3.0 Max. |
| Rust Prevention, (D-1743) | Pass | 1-1-1 max. |
| Copper Corrosion, (D-4048) | Pass | 2A Max. |
| Timkin OK Load, (D-2509) | 40 | 35 Min. |
| Four-Ball Wear, (D-2266) | 0.57 | 0.60 Max. |
| Four-Ball Load Wear Index, (D-2596) | 55 | 50 Min. |
| Four-Ball EP Weld Point, (D-2596) | 400 | 315 Min. |
| Approximate Temperature Range | +10 to 300° F. | |
| Viscosity @ 100° C., cSt | 65.8 | |
| Viscosity @ 40° C., cSt | 581 | |
| Viscosity Index | 188 | |

FEATURES:

1. 40 Lb. Timkin EP.
2. Superior Four-Ball EP and antiwear.
3. Excellent rust protection.
4. Oxidation inhibited.
5. Good high temperature properties.
6. Good adhesion/cohesion properties.
7. Excellent resistance to the effects of water.

Bioassays of the grease were conducted at Mudtech Laboratories, Inc., Houston, Tex. The testing was conducted using the guidelines in the August 1985 (Appendix 3) protocol specified by the United States Environmental Protection Agency. The 96-hour LC50 bioassay (using 3–6 day old *Mysidopsis bahia*) of the grease sample was estimated to be 63,200 ppm based on the probit method. An LC50 greater than 30,000 ppm is required to pass the test.

Surprisingly, this grease formulation provided better load carrying capacity than similar greases that contain 8% molybdenum sulfide as the load carrying additive:

| | Grease + 8 wt % Mo Sulfide | Grease |
|---|---|---|
| Four Ball EP | | |
| load wear index, Kg | 49.6 | 55 |
| weld point, Kg | 315 | 400 |
| Four Ball Wear, Scar Diameter, mm 75° C., 1200 RPM, 60 min., 40 Kg | 0.90 | 0.57 |

Additional advantages and modifications will be readily apparent to those skilled in the art. The invention in its broader aspects is therefore not limited to the specific details or representative examples described. Accordingly, departures may be made from the detail without departing from the spirit or scope of the disclosed general inventive concept.

What is claimed is:

1. An environmentally friendly grease composition, meeting or exceeding 1990 EPA acceptance standards defined by the 96-hour *Mysidopsis bahia* (shrimp) test for offshore and inland water use, comprising:

a petroleum white oil in an amount of about 65 to about 85 wt % based on total weight of the composition;

an extreme pressure additive comprising a solid crystalline friction modifier in an amount of about 1 to about 20 wt %, wherein said additive is essentially free of heavy metals;

a soap derived from animal or plant fatty oils in an amount of about 1 to about 20 wt %, wherein said soap is essentially free of heavy metals;

a natural clay in an amount of about 5 to about 20 wt %; and a minor amount of one or more oil dispersible additives added in an amount sufficient to enhance the performance characteristics of the grease composition, and wherein each additive is essentially free of heavy metals.

2. The grease composition of claim 1 wherein the white oil is medicinal white oil, food grade white oil, or technical grade white oil.

3. The grease composition of claim 1 wherein the friction modifier is white graphite, calcium carbonate, tricalcium phosphate, calcium fluoride, or calcium sulfate.

4. The grease composition of claim 1 wherein the soap is an aluminum or calcium complex soap.

5. The grease composition of claim 1 wherein the natural clay is bentonite.

6. The lubricating composition of claim 1 wherein one of the oil dispersible additives is an antioxidant.

7. The lubricating composition of claim 1 wherein one of the oil dispersible additives is an antifoaming agent.

8. The lubricating composition of claim 1 wherein one of the oil dispersible additives is a corrosion inhibitor.

9. The lubricating composition of claim 6 wherein the antioxidant is added in the amount of about 0.1 to about 2.0 wt %.

10. The lubricating composition of claim 7 wherein the antifoaming agent is added in the amount of about 50 to 200 parts per million.

11. The lubricating composition of claim 8 wherein the corrosion inhibitor is added in the amount of about 0.1 to about 1.0 wt %.

* * * * *

UNITED STATES PATENT AND TRADEMARK OFFICE

CERTIFICATE OF CORRECTION

PATENT NO. : 5,154,840

DATED : October 13, 1992

INVENTOR(S) : David A. Drake/Thomas F. Wulfers

It is certified that error appears in the above-indentified patent and that said Letters Patent is hereby corrected as shown below:

Col. 6:

In claim 6, line 1, please delete "lubricating" and insert therefor --grease--.

In claim 7, line 1, please delete "lubricating" and insert therefor --grease--.

In claim 8, line 1, please delete "lubricating" and insert therefor --grease--.

In claim 9, line 1, please delete "lubricating" and insert therefor --grease--.

In claim 10, line 1, please delete "lubricating" and insert therefor --grease--.

In claim 11, line 1, please delete "lubricating" and insert therefor --grease--.

At field [56] on the patent face, please list the following references:

| | | |
|---|---|---|
| U.S. Patent No. 4,787,992 | Waynick | 11/29/88 |
| U.S. Patent No. 4,652,385 | Cohen | 3/24/87 |
| U.S. Patent No. 4,310,428 | Ciuti | 1/12/82 |
| U.S. Patent No. 3,954,638 | Jones et al. | 5/ 4/76 |

ARCOwhite™ Food Grade Lubricants technical data brochure (U.S.A.)
Leg Jam/Rig Jam Grease Product Specifications (U.S.A.)
Grasso-Blue™ Leg-Jam Grease Material Safety Data Sheet (1991 U.S.A.)
Grasso-Blue™ Rig-Jam Grease Material Safety Data Sheet (1991 U.S.A.)

UNITED STATES PATENT AND TRADEMARK OFFICE

CERTIFICATE OF CORRECTION

PATENT NO. : 5,154,840

DATED : October 13, 1992

INVENTOR(S) : David A. Drake/Thomas F. Wulfers

It is certified that error appears in the above-indentified patent and that said Letters Patent is hereby corrected as shown below:

News article, "New Lubricants Won't Harm Ocean," The Houston Post (2/17/91 U.S.A.)

Signed and Sealed this

Second Day of November, 1993

*Attest:*

Bruce Lehman

BRUCE LEHMAN

*Attesting Officer*

*Commissioner of Patents and Trademarks*